United States Patent [19]

Stumpff et al.

[11] Patent Number: 4,761,525

[45] Date of Patent: Aug. 2, 1988

[54] ELECTRICAL SWITCH APPARATUS HAVING A WIRE ENGAGING ELECTRICAL CONDUCTING MEMBER

[75] Inventors: Phillip W. Stumpff, Madill; Richard D. Taylor, Kingston, both of Okla.

[73] Assignee: Philrich Innovators Research Manufacturing and Development, Inc., Madill, Okla.

[21] Appl. No.: 939,189

[22] Filed: Dec. 8, 1986

[51] Int. Cl.[4] ..... H01H 1/58

[52] U.S. Cl. ..... 200/284; 439/787; 200/153 L

[58] Field of Search ..... 200/284, 153 L; 439/786, 787, 790

[56] References Cited

U.S. PATENT DOCUMENTS

| | | | |
|---|---|---|---|
| Re. 29,513 | 6/1978 | Johnson | 439/487 |
| 2,725,544 | 11/1955 | Strange | 439/441 |
| 2,738,482 | 3/1956 | Benander | 439/441 |
| 2,795,677 | 6/1957 | Slater | 200/284 |
| 2,890,436 | 6/1959 | Bentley | 439/787 |
| 3,030,479 | 4/1962 | Ehrlich et al. | 200/284 |
| 3,097,906 | 7/1963 | Shannon | 439/855 |
| 3,165,614 | 1/1965 | Carissimi et al. | 200/284 |
| 3,323,099 | 5/1967 | Spera | 439/724 |
| 3,339,170 | 8/1967 | Martin | 439/516 |
| 3,393,397 | 7/1968 | Manichl | 439/439 |
| 3,451,037 | 6/1969 | Herrli | 439/632 |
| 3,532,846 | 10/1970 | Schumacher | 200/284 |
| 3,569,911 | 3/1971 | Bogdanowicz | 439/441 |
| 3,585,570 | 6/1971 | Jans | 439/439 |
| 3,652,811 | 3/1972 | Barney | 200/284 |
| 3,717,840 | 2/1973 | Vaughan et al. | 439/466 |
| 3,828,113 | 8/1974 | Bourne | 174/55 |
| 3,863,037 | 1/1975 | Schindler et al. | 174/58 |
| 3,885,852 | 5/1975 | Grove | 439/441 |
| 3,916,149 | 10/1975 | Skinner | 219/335 |
| 3,922,478 | 11/1975 | Perkey | 174/53 |
| 3,936,126 | 2/1976 | Miller | 439/441 |
| 3,945,711 | 3/1976 | Hohorst et al. | 439/723 |
| 4,012,100 | 3/1977 | Viscosi | 439/439 |
| 4,106,835 | 8/1978 | Kimm | 439/441 |
| 4,165,443 | 8/1979 | Figart et al. | 174/53 |
| 4,166,934 | 9/1979 | Marrero | 200/51 R |
| 4,210,772 | 7/1980 | Magana et al. | 174/59 |
| 4,295,018 | 10/1981 | Borrelli | 200/51.09 |
| 4,336,418 | 6/1982 | Hoag | 174/53 |
| 4,420,215 | 12/1983 | Tengler | 439/728 |
| 4,609,898 | 9/1986 | Seymour et al. | 200/293 |

FOREIGN PATENT DOCUMENTS

| | | | |
|---|---|---|---|
| 963217 | 7/1964 | United Kingdom | 200/284 |

OTHER PUBLICATIONS

Photographs of electrical switch manufactured by General Electric Company.

*Primary Examiner*—Renee S. Luebke

*Attorney, Agent, or Firm*—Laney, Dougherty, Hessin & Beavers

[57] ABSTRACT

An electrical switch apparatus adapted for plug-in wiring. The switch apparatus has an insulating housing made of a cover and a body. The body defines a plurality of terminal receiving cavities therein. A terminal portion of a plurality of electrical contact strips is disposed in each of the terminal receiving cavities. The terminal portions are adapted for receiving and grippingly engaging an electrical wire inserted through an opening in the housing. A cantilevered strip extends from each of the terminal portions, and each of the cantilevered strips has a switching contact thereon. The contacts on each of the cantilevered strips are mutually aligned. When the switch handle is in a first position, the contacts on a pair of the electrical contact strips are in electrical communication. When the switch is in a second position, the electrical contacts on another pair of electrical contact strips are in electrical communication. The switch handle has a pin thereon for engaging one of the contact strips. The switch handle also has a lug thereon which is biasingly engaged by a spring such that movement of the switch between the first and second positions is facilitated as the switch handle is moved through a center position. The cover of the housing further includes walls or partitions thereon separating, aligning and supporting the cantilevered strips.

44 Claims, 3 Drawing Sheets

ELECTRICAL SWITCH APPARATUS HAVING A WIRE ENGAGING ELECTRICAL CONDUCTING MEMBER

BACKGROUND OF THE INVENTION

1. Field of the Invention

This invention relates to a plug-in type electrical switch apparatus for use in constructing the wiring system of a house or other building, and more particularly, to a switch apparatus having a plurality of cantilevered electrical contact strips with electrical switching contacts thereon.

2. Description of the Prior Art

When a new building is being wired or an older building is being rewired, considerable time must be spent in making electrical connections within and between conventional junction, switch and receptacle boxes, and considerable time must be spent in mounting such boxes. Accordingly, a need exists for an electrical switch box with which various electrical conductors may be quickly electrically connected in order to provide the electrical circuitry, and which may be quickly mounted from joists and studs.

The prior art includes wiring systems having plug-in type connections, such as seen in U.S. Pat. No. 4,165,443 to Figart et al.

Also, the prior art has included electrical boxes having offset flanges for the mounting of the box on studs, and the face of the boxes extending from the stud at a distance equal to the thickness of the wall board to be used with the device, is seen in U.S. Pat. No. 3,863,037 to Schindler et al.

Other examples of various forms of electrical connection apparatus, including plug-in connectors, and in some instances some of the other general structural operational features of the present invention, may include U.S. Pat. Nos. 3,391,170; 3,393,397; 3,451,037; 3,569,911; 3,717,840; 3,828,113; 3,885,852; 3,945,711; 4,012,100; and 4,106,835. Specifically, electrical switches are shown in U.S. Pat. Nos. 4,166,934 and 4,336,418.

In spite of the numerous attempts which have been made to develop a practical alternative to conventional junction, switch and receptacle boxes, some of which attempts are shown in the above-cited references, none of these attempts have succeeded in providing a system which has found widespread acceptance in the marketplace. There is still the need for much improvement in plug-in type electrical boxes, and the present invention provides an electrical switch apparatus addressing such needs.

A typical electrical switch, such as manufactured by General Electric, has an insulating housing with a switch handle positioned therein and held in place by a mounting plate. Disposed within the insulated housing are a pair of electrically conducting contacts, each with a screw terminal for attachment of a wire thereto. A substantially U-shaped switch element may be pivoted into contact with the two terminals, thus providing electrical communication therebetween when the switch is in an ON position. When the switch is in an OFF position, the U-shaped switch element is pivoted to a position spaced from the two terminals. The two screw terminals provide for attachment of power and common wires thereto.

A spring is disposed between the switch handle and the switch element, and the spring provides a snap action as the switch is moved over center between the ON and OFF positions. Such as over-center mechanism is shown in U.S. Pat. No. 3,738,482 to Benander.

While the General Electric-type apparatus is in widespread use, and thus economically manufactured in large quantities, there is a need for a simplified electrical switch apparatus which reduces the number of parts, as well as providing plug-in wiring as discussed above. The present invention, utilizing a two-piece housing which also acts as the switch box and includes three contact strips therein, including a grounding strip in one embodiment, simplifies the parts required, as well as provides a plug-in rather than screw terminal system. The improvements of the present invention also provide an electrical switch apparatus which includes conventionally manufactured parts and one which is quickly assembled.

SUMMARY OF THE INVENTION

The electric switch apparatus of the present invention comprises an insulating housing defining a wire receiving housing opening and a switch handle opening therein, an electrical contact strip or member disposed in the housing, and a switch handle disposed in the housing and movable between a first and a second position. The electrical contact member comprises wire receiving means for receiving an electrical wire and a cantilevered strip extending from the wire receiving means. The switch handle comprises strip engaging means thereon for engaging the cantilevered strip at least when the switch handle is in one of the first and second positions. Supporting means are provided for supporting the cantilevered strip at least when the strip engaging means is engaged with the cantilevered strip.

The wire engaging means comprises a web portion having a wire receiving web opening disposed therethrough and first and second leg portions extending from the web portions. The leg portions are arranged for engagingly receiving the wire therebetween. The web portion is an elongated web portion and has an extended portion from which the cantilevered strip extends. The web opening is one of a plurality of aligned web openings disposed through the elongated web portion. Each of the leg portions is an elongated leg portion, and at least one of the first and second leg portions is split transversely to a length thereof between adjacent web openings, so that the leg portions can engagingly receive different sizes of wire in the adjacent web openings.

In an alternate embodiment, shoulder means are provided adjacent the wire receiving means for engaging the wire and providing increased electrical contact therewith. Preferably, the shoulder means is characterized by a shoulder stamped from one of the first and second leg portions and extending substantially perpendicular to the web portion.

The housing defines at least one socket with a plurality of wire receiving housing openings therein, and the housing openings are aligned with corresponding wire receiving web openings.

At least a part of one of the first and second leg portions is arcuate in cross section with a convex side thereof facing the other of the leg portions. The other leg portion has a planar part adjacent and offset towards the convex side of the one leg portion, so that the wires are engagingly gripped between the convex side of the arcuate part of the one leg portion and the planar part of the other leg portion with at least one leg portion resiliently biased against the wire.

The wire receiving means further comprises retaining means for engaging the wire when the wire is inserted through the wire receiving web opening and for resisting withdrawal of the wire from the opening. Preferably, the retaining means is a resilient tab punched from the web portion. The tab has a fixed end integrally attached to the web portion and further has a free end extending from the web portion. The free end of the tab has a notch therein for engaging the wire.

The electrical contact member disposed in the housing is preferably one of a plurality of such electrical conducting members comprising, in a first, one-way switch embodiment, an electrical conducting power member, an electrical conducting common member, and an electrical conducting ground or neutral member. In a second, three-way switch embodiment, the three electrical conducting members comprise a normally open electrical conducting member, an electrical conducting common member, and a normally closed electrical conducting member.

In the first embodiment, the apparatus further comprises grounding means for grounding the common member with the ground member when the switch handle is in the first position. the grounding means includes a contact on the common member engageable with a similar contact on the grounding member. The power member also includes an electrical contact, and the contacts on each of the electrical conducting members are mutually aligned. A contact on the common member is brought into electrical communication with a contact on the power member when the switch handle is moved to the second position.

For the three-way switch embodiment, a contact on the common member can be moved to be alternately in electrical communication with corresponding contacts on the normally open and closed members.

With either embodiment, strip engaging means are provided on the switch handle for engaging the cantilevered strip of the common member so that it can be placed alternately in electrical communication with the cantilevered strips of the other two members. The strip engaging means includes a pin extending radially from a shaft portion of the switch handle.

The apparatus further comprises over-center biasing means for facilitating movement of the switch handle as the switch handle is moved through a center position between the first and second positions thereof. Preferably, the over-center biasing means comprises a spring adjacent the switch handle and spring engaging means on the switch handle for engaging the spring, such that the spring biases the switch handle in the direction of rotation as the switch is moved over center. The spring engaging means comprises a lug extending radially from the shaft portion of the switch handle, and the spring is resiliently biased in a direction substantially perpendicular to an axis of the shaft and has a curvilinear portion with a convex surface facing and engaging the lug.

The housing further comprises mounting means for mounting to a wall member, and the mounting means is characterized by a flange extending from a cover of the housing.

An important object of the present invention is to provide an electrical switch apparatus with a plug-in wiring system and which is easily assembled and installed.

Another object of the invention is to provide an electrical switch apparatus having an electrical contact strip therein in which the contact strip includes wire receiving means and a cantilevered strip with switching contact means thereon.

A further object of the present invention is to provide an electrical switch apparatus having a switch handle with a lug thereon and an elongated spring biasingly engaging the lug for facilitating movement of the handle.

Still another object of the present invention is to provide an electrical switch apparatus adaptable for either one-way or three-way operation.

Other objects and advantages of the invention will become apparent to those skilled in the art when the following detailed description of the preferred embodiment is read in conjunction with the drawings which illustrate such preferred embodiment.

DESCRIPTION OF THE PREFERRED EMBODIMENT

Figure 1:
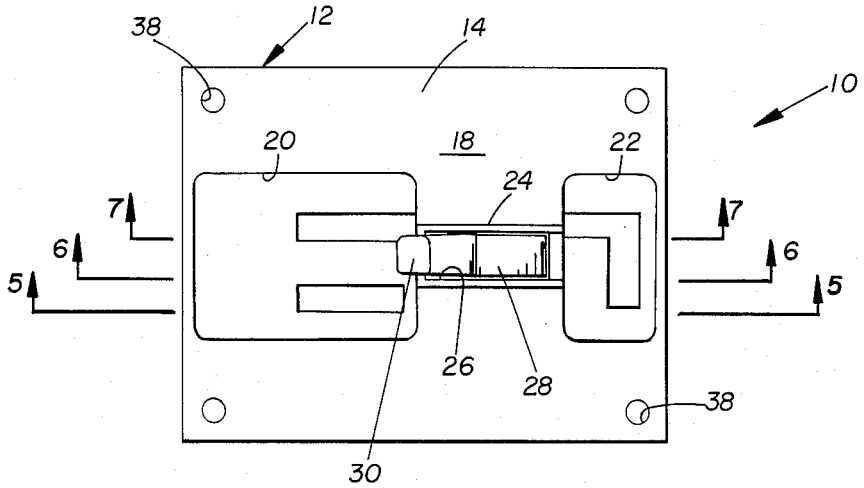
FIG. 1 shows a front view of the electrical switch apparatus of the present invention.
Figure 2:
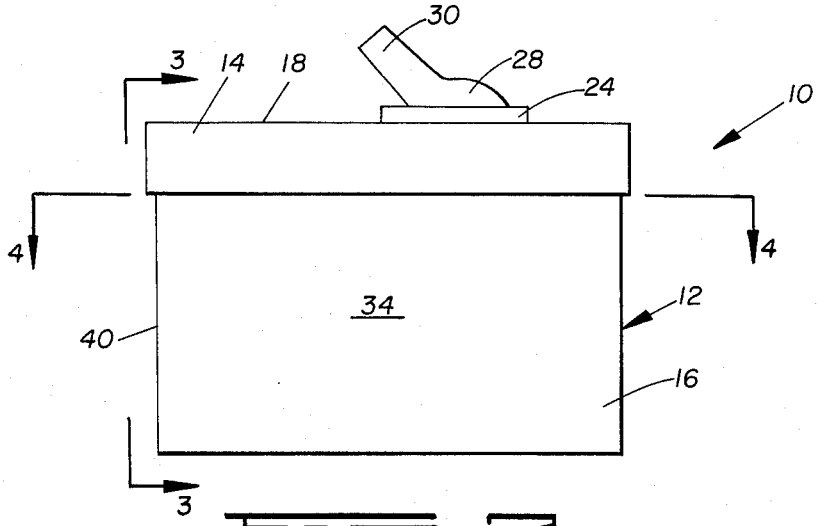
FIG. 2 is a side view of the apparatus.
Figure 3:
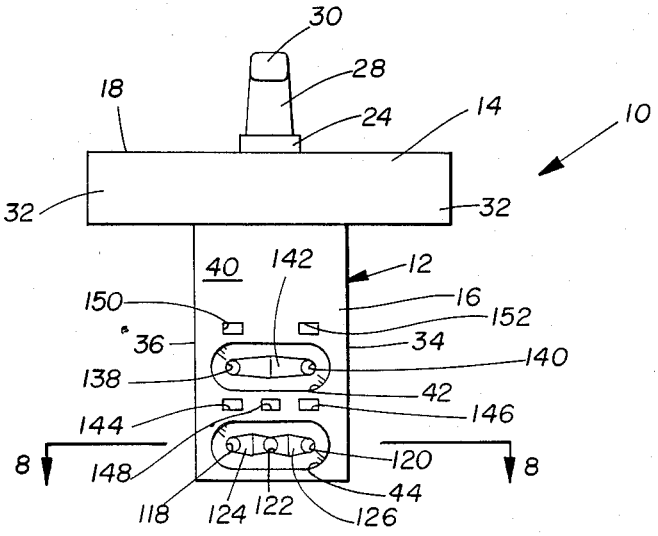
FIG. 3 is an end view as seen from lines 3—3 in FIG. 2 and illustrating wire receiving housing openings therein.

Referring now to the drawings, and more particularly, to FIGS. 1-3, the electrical switch apparatus of the present invention is shown and generally designated by the numeral 10. Apparatus 10 includes an insulating enclosure or housing 12 having first and second housing sections in the form of a cover 14 and a body 16.

The face of cover 14 includes a substantially planar portion 18 having irregularly shaped recesses 20 and 22 therein. Recesses 20 and 22 follow the contour of the underside of the cover, hereinafter described in more detail, and these recesses serve merely to eliminate undesirably thick cross sections when cover 14 is molded of an insulating material such as plastic.

Extending from planar portion 18 of cover 14 is a protruding switch handle guide portion 24 defining a substantially rectangular switch handle opening 26 therethrough. A switch handle 28 has a lever portion 30 which extends outwardly through opening 26 in a manner known in the art. Further details of switch handle 28 will be discussed hereinafter.

Planar portion 18 of cover 14 has flange portions 32 extending in opposite directions from sides 34 and 36 of body 16. Each flange portion 34 and 36 has at least one mounting hole 38 therethrough adjacent each corner, so that housing 12 may be easily mounted to a wall member, such as a stud. Typically, flange portion 32 will be on the outward edge of the stud, and side 34 or 36 of body 16 will be adjacent a side of the stud.

End 40 of body 16 has a pair of cable receiving external sockets 42 and 44, which are similar in construction. As will be hereinafter discussed in more detail, each socket 42 and 44 is constructed for use with electrical cables.

Referring now to FIGS. 4–7, details of body 16 are shown. In addition to end 40, body 16 has another end 46 opposite end 40. An internal cavity 48 is defined by sides 34 and 36, end 46, bottom wall 50 and an internal, longitudinally intermediate transverse wall 52. Cavity 48 opens outwardly toward cover 14.

Disposed between internal wall 52 and end 40 of body 16 are terminal receiving means, preferably characterized by a plurality of terminal receiving means, preferably characterized by a plurality of terminal receiving cavities identified for a first, one-way switch embodiment as a power terminal receiving cavity 54, a common terminal receiving cavity 56 spaced from receiving cavity 54, and a ground or neutral terminal receiving cavity 58 transversely positioned between cavities 54 and 56. Cavities 54, 56 and 58 are substantially parallel and extend longitudinally in body 16.

Figure 8:
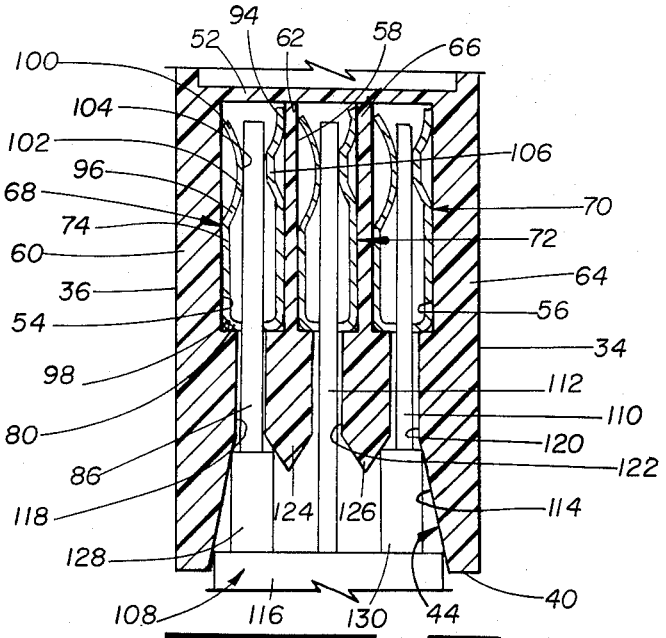
FIG. 8 is a fragmentary cross-sectional view taken along lines 8—8 in FIG. 3.

Referring now also to FIG. 8, it will be seen that cavity 54 is bounded by an enlarged wall portion 60 of side 36 and an intermediate wall 62. Receiving cavity 56 is bounded by an enlarged wall portion 64 of side 34 and a second intermediate wall 66. Terminal receiving cavity 58 is bounded by intermediate walls 62 and 66. All three of cavities 54, 56 and 58 are also bounded on the lower side by bottom wall 50 and open outwardly therefrom.

Disposed in body 16 are electrical conducting means, preferably in the form of three electrical contact strips or members identified in the first embodiment as a power contact strip 68, a common contact strip 70, and a ground or neutral contact strip 72. Power contact strip 68 has a terminal portion 74 positioned in terminal receiving cavity 54. Common contact strip 70 includes a terminal portion 76 positioned in terminal receiving cavity 56. Similarly, ground contact strip 72 includes a terminal portion 78 disposed in terminal receiving cavity 58.

Figure 9:
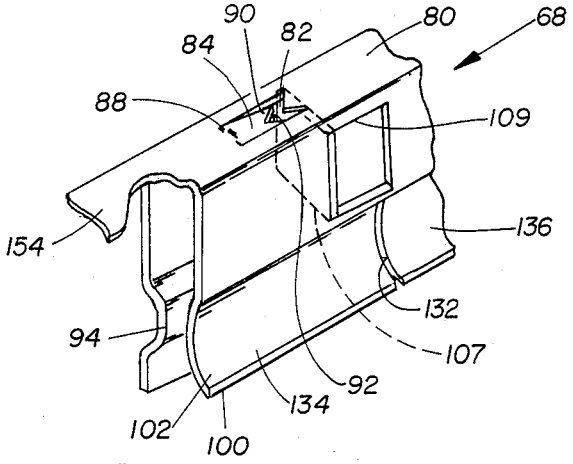
FIG. 9 is a partial isometric view of an electrical contact strip used in the apparatus.

Each of terminal portions 74, 76 and 78 are similarly constructed, and the general construction of any one of the terminal portions will be described with particular reference to terminal portion 74 of power contact strip 68. Terminal portion 74 has a first end facing toward end 40 of body 16 and thus toward sockets 42 and 44. The first end includes a metal elongated web portion 80 having wire receiving web openings 82 disposed therethrough. Referring also to FIG. 9, each web opening 82 is formed by punching a resilient tab 84 from web 80. Tab 84 may further be described as a wire retaining means for engaging and retaining a wire 86 inserted through web opening 82 and for resisting withdrawal of such a wire from the web opening as further described herein.

Each of resilient tabs 84 has a fixed end 88 and a free end 90. Free ends 90 are deflected away from web portion 80 toward internal wall 52. Free ends 90 of resilient tabs 84 have notches 92 disposed therein for engaging wire 86. Preferably, but not by way of limitation, notches 92 are V-notches are shown in FIG. 9.

Terminal portion 74 of power contact strip 68 further includes first and second elongated leg portions 94 and 96 extending away from web portion 80 toward internal wall 52. First and second leg portions 94 and 96 of each terminal portion are arranged to engagingly receive a wire, such as wire 86, therebetween.

Web portion 80 of terminal portion 74 of power contact strip 68 engages a wall 98 which in part bounds receiving cavity 54 and is opposite internal wall 52. The end of first leg portion 94 opposite web portion 80 is adjacent internal wall 52.

Second leg portion 96 of terminal portion 74 of power contact strip 68, however, has a free end 100 which engages enlarged wall portion 60 of side 36 of body 16. Free end 100 is spaced from internal wall 52.

Second leg portion 96 is a flexible leg portion and is constructed so that it is flexed upon insertion of wire 86 between first and second leg portions 94 and 96. As second leg portion 96 is flexed upon insertion of a wire, such as wire 86, between leg portions 94 and 96, free end 100 thereof slides longitudinally along wall portion 60 toward internal wall 52.

A distal portion 102 of second leg portion 96 is arcuate in cross section and has a convex side 104 facing first leg portion 94. First leg portion 94 has a planar part 106 which is adjacent and offset toward arcuate portion 102 of second leg portion 96.

When wire 86 is inserted between first and second leg portions 94 and 96, it is engagingly gripped between the convex side 104 of arcuate portion 102 of second leg portion 96 and planar part 106 of first leg portion 94.

As wire 86 is inserted between first and second leg portions 94 and 96, first leg portion 94 remains relatively fixed, since its lower end is adjacent internal wall 52, and the arcuate cross-sectional portion 102 of second leg portion 96 flexes by flattening the arc thereof. This causes second leg portion 96 to be resiliently biased against wire 86 so that it pushes against the wire and accordingly pushes the wire against planar part 106 of first leg portion 94.

Due to the large flat area of planar part 106, a large area of electrical contact is provided between wire 86 and first leg portion 94.

Referring again to FIG. 9, an alternate shoulder 107 is disposed between leg portions 94 and 96 and adjacent each web opening 82 and the corresponding tab 84. Shoulder 107 is preferably formed by punching the shoulder away from the flat upper portion of second leg 96. In this way, a window 109 is formed in second leg 96. Window 109 has no function other than being the result of the formation of shoulder 107. Each shoulder 107 is spaced from, and generally faces, free end 90 of each tab 84 in all of the contact strips. As the wire is inserted through web opening 82, shoulder 107 engages the wire and provides a means for increased area of electrical contact between the wire and the contact strip compared to the first embodiment.

As shown in FIG. 3, and as already discussed herein, body 16 has a pair of cable receiving external sockets 42 and 44 therein, both of which are similar in construction. Both sockets 42 and 44 are shown in cross section in FIGS. 5–7.

Socket 44 is also shown in cross section in more detail in FIG. 8, and the following description of socket 44 is generally applicable to both sockets.

Socket 44 is constructed for use with a cable 108. Cable 108 is preferably a three-wire conductor having a power wire 86, already discussed, and further having a common wire 110 and a ground or neutral wire 112.

Socket 44 is defined by a side wall 114 which is convergingly tapered toward the bottom of the socket. Tapered side wall 114 wedgingly engages outer casing 116 of cable 108. At the bottom of socket 44 are first and second aligned outer housing openings 118 and 120, along with a third aligned center opening 122, disposed therethrough. Openings 118, 120 and 122 are aligned with web openings 82 in web portion 80 of terminal portion 74 of power contact strip 68, terminal portion 76 of common contact strip 70, and terminal portion 78 of ground contact strip 72, respectively.

Socket 44 further includes first and second tapered mid-walls 124 and 126, respectively. The tapered walls in socket 44 are thus also adapted to receive an inner insulating sheath, such as sheath 128 around power wire 86, which is shown wedgingly engaged with tapered mid-wall 124 and tapered side wall 114. Similarly, another insulating sheath 130 around common wire 110 is shown wedgingly engaged with tapered mid-wall 126 and side wall 114.

When cable 108 is inserted into socket 144, it is very snugly held therein through a combination of the already described resilient gripping action of terminal portions 74, 76 and 78, on power wire 86, common wire 110 and ground wire 112, respectively, in combination with the wedging action of casing 116 with tapered side wall 114, and the wedging action of inner sheaths 128 and 130 between tapered mid-walls 124 and 126, respectively, and tapered wall 114.

Referring again to FIG. 9, a transverse slot 132 is defined in second leg portion 96 of terminal portion 74. Slot 132 extends from free end 100 of second leg portion 96 and stops at approximately the opposite end of arcuate portion 102 thereof. Thus, arcuate portion 102 is divided into first and second sections 134 and 136, respectively. It will be seen that slot 132 is also longitudinally located between a pair of web openings 82 in web portion 80 of terminal portion 74. Thus, sections 134 and 136 of arcuate portion 102 of second leg portion 96 flex separately to compensate for varying thicknesses in wire size.

Socket 42 is similar in nearly all respects to socket 44. In the first, one-way switch embodiment, however, socket 42 only has a pair of openings 138 and 140 therethrough, as shown in FIG. 3. Opening 138 is aligned with a web opening 82 in terminal portion 74 of power contact strip 68, and opening 140 is aligned with a similar web opening 82 in terminal portion 76 of common contact strip 70. A single mid-wall 142 is disposed between openings 138 and 140, and mid-wall 142 serves to grippingly engage the insulating sheath of a cable in conjunction with the side wall of socket 42. This gripping is similar to that described above for socket 44. As will be described in more detail hereinafter, for a second, three-way switch embodiment, socket 42 is substantially identical to socket 44, already described, and thus has three aligned openings therethrough, substantially identical to openings 118, 120 and 122 in socket 44, and two midwalls, substantially identical to mid-walls 124 and 126 in socket 44.

Referring again to FIGS. 3 and 5–7, each of housing openings such as 118, 122, 120, 138 and 140 has associated therewith a rectangular opening such as 144, 146, 148, 150 and 152, respectively. Rectangular openings 144, 146, 148, 150 and 152 extend through end 40 of body 16 and provide access for a tool to engage adjacent resilient tabs 84 near their fixed ends 88, so that the resilient tabs may be deflected away from corresponding web portions 80 to release the respective wires received through openings 118, 120, 122, 138 and 140.

Referring now again to FIGS. 4–7, further details of power contact strip 68, common contact strip 70 and ground contact strip 72 are shown.

Web portion 80 of terminal portion 74 of power contact strip 68 has an extended portion 154 extending in a direction opposite bottom wall 50. Web portion 80 of terminal portion 76 of common contact strip 70 has a similar extended portion 156. Web portion 80 of terminal portion 78 of ground contact strip 72 also has an extended portion 158 extending in a direction away from bottom wall 50.

A cantilevered strip 160 extends from extended portion 154 of power contact strip 68 in substantially the same longitudinal direction as first and second leg portions 94 and 96 thereof. Cantilevered strip 160 includes a first, fixed end 162 attached to extend portion 154 and a second, free end 164 spaced from fixed end 162. Free end 164 has a substantially L-shaped portion including a transverse portion 166 extending in a direction substantially toward common contact strip 70, and a short longitudinal portion 168 extending from transverse portion 166 in a longitudinal direction toward common contact strip 70. Attached to an outwardly facing surface of short longitudinal portion 168 is an electrical switching contact or lug 170.

Figure 5:
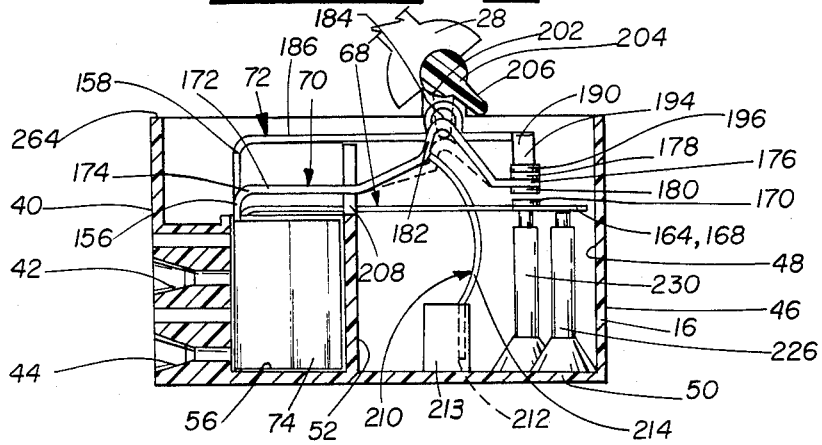
FIG. 5 is a longitudinal cross section taken along lines 5—5 of FIG. 1 with the cover removed.
Figure 6:
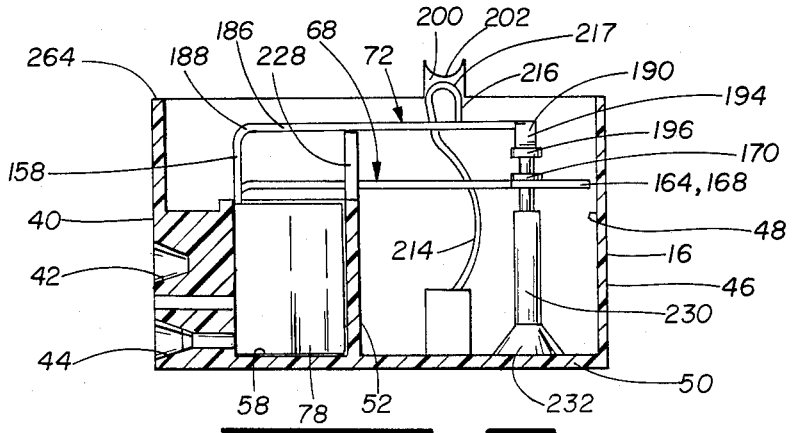
FIG. 6 is a longitudinal cross section taken along lines 6—6 of FIG. 1 with the cover and switch handle removed.

Common contact strip 70 includes a longitudinally extending cantilevered strip 172 having a first, fixed end 174 attached to extended portion 156 and a second, free end 176. Attached to first, outwardly facing and second, inwardly facing surfaces of free end 176 of cantilevered strip 172 are aligned first and second electrical switching contacts or lugs 178 and 180, respectively. It will be seen that electrical contacts 178 and 180 are adapted to be mutually aligned with electrical contact 170 of power contact strip 68, with electrical contact 180 normally spaced from electrical contact 170, as best shown in FIG. 5. cantilevered strip 172 of common contact strip 70 includes a curvilinear intermediate portion 182 extending away from bottom wall 50. Intermediate portion 182 has a convex surface 184 facing away from bottom wall 50.

Ground contact strip 72 also includes a longitudinally extending cantilevered strip 186 having a first, fixed end 188 attached to extended portion 158 and a second, free end 190. Free end 190 includes a transverse portion 192 extending toward common contact strip 70 and having a portion 194 extending toward bottom wall 50 with an electrical switching contact or lug 196 on a surface thereof facing bottom wall 50. Contact 196 is mutually aligned with contacts 170, 178 and 180, and it will be seen in FIG. 5 that electrical contact 196 is normally in electrical communication with upper contact 178 on common contact strip 70.

As shown in FIGS. 4–7, body 16 includes cradle portions 198 and 200 extending from side walls 34 and 36, respectively, in a direction opposite bottom all 50. Each cradle includes a concave surface 202 adapted for pivotally receiving a shaft portion 204 of switch handle 28. As will be hereinafter described, shaft 204 is also received in cover 14 of housing 12.

Referring now to FIG. 5, the first embodiment of electrical switch apparatus 10 of the present invention is shown in a first or OFF position with cover 14 removed. Switch handle 28 is shown in place with shaft portion 204 thereof in pivotal contact with concave surface 202. Extending radially from shaft portion 204 is a pin 206 which is transversely aligned with cantilevered portion 172 of common contact strip 70, such that pin 206 is adjacent convex surface 184 of intermediate portion 182 of cantilevered strip 172. As already discussed herein, in this position, electrical contact 178 of common contact strip 70 is in electrical communication with contact 196 of ground contact strip 72, and contact 176 is spaced from contact 170 on power contact strip 68. Thus, common contact strip 70 is grounded to ground contact strip 72.

If switch handle 28 is pivoted in a clockwise direction as shown in FIG. 5, the apparatus will be switched to a second or ON position. Pin 206 will be correspondingly moved to a position substantially perpendicular to bottom wall 50 of body 16 in which pin 206 contacts convex surface 184 and deflects intermediate portion 182 toward bottom wall 50. The portion of cantilevered strip 172 adjacent fixed end 174 thereof is supported by a post 208 extending from internal wall 52. When intermediate portion 182 of cantilevered strip 172 is thus deflected, lower electrical contact 180 is correspondingly moved so that it is placed in electrical communication with contact 170 on power contact strip 68. Thus, when the apparatus is in the second or ON position, common contact strip 70 is placed in electrical communication with power strip 68. In this second position, upper contact 178 on common contact strip 70 is spaced from contact 196 on ground contact strip 72.

When a cable such as cable 108 is plugged into socket 44 from a power source, power contact strip 68, common contact strip 70 and ground contact strip 72 are all appropriately wired to the power source. Normally, the device to be switched, such as a lighting fixture or electrical receptacle, will have a pair of wires leading therefrom. When these two wires are plugged into openings 138 and 140, respectively, in socket 42, it will thus be seen that a switched connection has been made, and by moving switch handle 28 between the OFF and ON positions, as hereinbefore described, the device to be switched may be electrically controlled.

It will be seen that those skilled in the art that the above description is applicable, as mentioned, to a one-way switch configuration and corresponding electrical control of the device to be switched. However, the present invention is easily modified to become a three-way switch to be used with another similar switch. If socket 42 in body 16 has a center opening therein, thus making it identical to socket 44, obviously three wires also may be plugged into socket 42. The three wires connected with socket 42 are identical to the three wires already known in the art which are used to connect two previously known three-way switches.

As the apparatus is shown in FIGS. 4–7, contact strips 68, 70 and 72 remain physically unchanged for the three-way switch embodiment. Common contact strip 70 is still a common electrical conducting member. However, contact strip 68 is now identified as a normally open contact strip 68 of the three-way switch, and contact strip 72 is identified as a normally closed contact strip 72. Pivotation of switch handle 28 between the first and second positions alternately opens contact strip 68/closes contact strip 72 and closes contact strip 68/opens contact strip 72, respectively. When connected to another switch apparatus 10, it will be seen that a three-way control is provided for the device to be switched.

Referring once again to FIGS. 4–7, an elongated spring 210 is positioned adjacent wall 36 of body 16. Spring 210 is substantially normal to bottom wall 50 of body 16. Spring 210 has a fixed end 212 held in place by a locating block 213 attached to body 16, and extending upwardly from fixed end 212 is a curvilinear intermediate portion 214. Spring 210 terminates with a substantially U-shaped free end 216 having a convex surface 217 thereon facing away from bottom wall 50.

Figure 7:
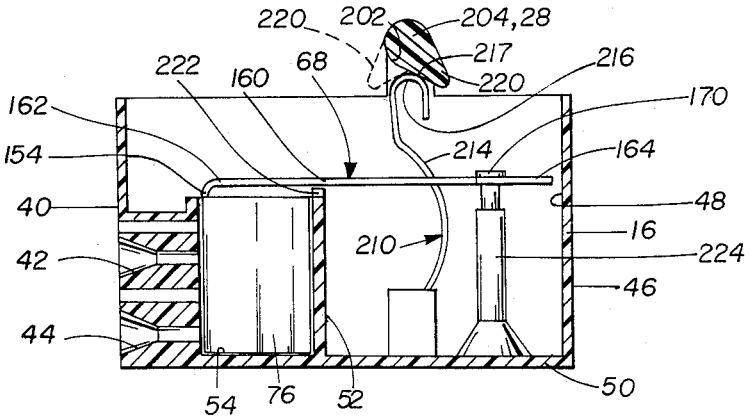
FIG. 7 illustrates another longitudinal cross-sectional view taken along lines 7—7 of FIG. 1 with the cover removed.
Figure 10:
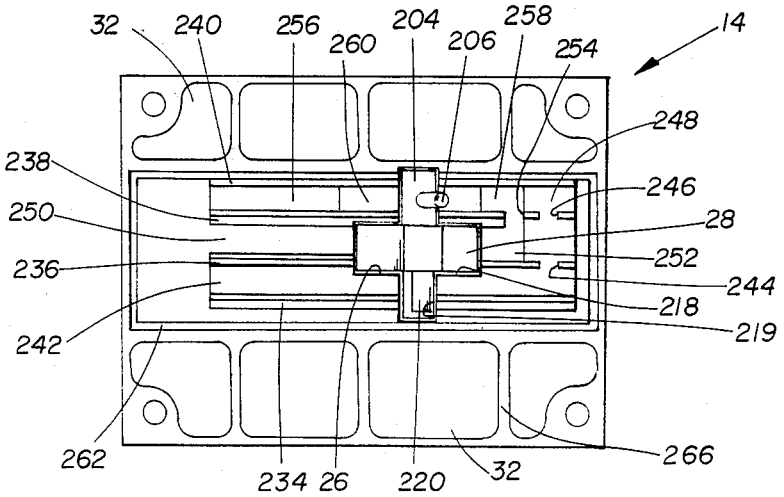
FIG. 10 shows a rear view of the cover of the housing with the switch handle positioned therein.

Referring now to FIG. 10, cover 14 includes a cavity 218 for receiving switch handle 28. Transverse end 219 of cavity 218 also receives, and longitudinally locates and retains, free end 216 of spring 210. Transversely aligned with spring 210 in transverse end 219 of cavity 218 is a tooth or lug 220 which extends from shaft portion 204 of switch handle 28 and engages convex surface 217 on spring 210, as best shown in FIG. 7. As switch handle 28 is moved from the first position, shown in solid lines in FIG. 7, to the second position, shown in broken lines in FIG. 7, it will be seen that lug 220 will be forced against convex surface 217 of spring 210. Because free end 216 of spring 210 is longitudinally restrained in transverse end 219 of cavity 218 in cover 14, upper end 216 of the spring will be deflected toward bottom wall 50 by lug 220, away from cover 14 and shaft 204 of switch handle 28.

As lug 220 passes through the center of convex surface 217 of spring 210, it will be seen that spring 210 will be engaged with the opposite side of lug 220 and will tend to return to its original position and thus facilitate the rotational movement of switch handle 28 to the second position by bearing on lug 220 and forcing the lug to move in a clockwise direction. When returning the switch from the second position to the first position, it will be seen that the reverse will occur. Thus, spring 210 in combination with lug 220 provides over-center biasing means for biasing the lug and thereby facilitating movement of the switch handle between the first and second positions.

In addition to the supporting means in the form of post 208 for cantilevered strip 172 of common contact strip 70, additional supporting means are provided for cantilevered strips 160 and 186 of power contact strip 68 and ground contact strip 72, respectively. Preferably, the supporting means comprises a plurality of posts in cavity 48 of body 16. Post 222 extends from internal wall 52 to support an intermediate portion of cantilevered strip 160 of power contact strip 68. A pair of substantially cylindrical posts 224 and 226 support free end 164 of cantilevered strip 160. Post 226 is preferably positioned at the intersection of transverse portion 166 and longitudinal portion 168. Similarly, post 228, extending from intermediate wall 52, supports an intermediate portion of cantilevered strip 186 of ground contact strip 72, and a substantially cylindrical post 230 supports free end 190 of cantilevered strip 186. Cylindrical posts 224, 226 and 230 include substantially conical bases, such as base 232 on post 230, adjacent to bottom wall 50.

Figure 4:
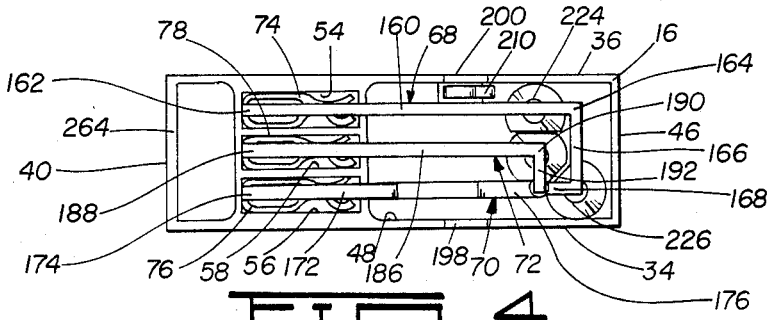
FIG. 4 is a front view of the electrical switch apparatus of the present invention with the switch handle and the cover portion of the housing removed.

Referring once again to FIG. 10 which shows the back side of cover 14, and with some reference also to FIG. 4, cantilevered strips 160, 172 and 186 of power contact strip 68, common contact strip 70 and ground contact strip 72, respectively, are separated, located and supported by a plurality of substantially longitudinal insulating partitions or walls 234, 236, 238 and 240 which extend from cover 14 toward body 16. Walls 234, 236, 238 and 240 are integrally formed with cover 14.

A relatively shallow longitudinal slot 242 is defined between walls 234 and 236. Longitudinal slot 242 is in communication with transverse slots 244 and 246 in walls 236 and 238, respectively. Slot 246 is in turn in communication with a short longitudinal slot 248 between walls 238 and 240. A study of FIGS. 4 and 10 will show that slots 242, 244, 246 and 248 are adapted for receiving, aligning and supporting cantilevered strip 160 of power contact strip 68 when apparatus 10 is assembled.

A relatively deeper longitudinal slot 250 and an aligned longitudinal slot 252 are defined between walls 236 and 238 on opposite sides of cavity 218. Slot 252 is in communication with a transverse slot 254 in wall 238. Slots 250, 252 and 254 are thus adapted for receiving aligning and supporting cantilevered strip 186 of ground contact strip 72.

Aligned shallow longitudinal slots 256 and 258 and a relatively deeper longitudinal slot 260 are defined between walls 238 and 240 in cover 14. Deeper slot 260 is adapted for receiving, aligning and supporting intermediate portion 182 of cantilevered strip 172 of common contact strip 70, and slots 256 and 258 receive, align and support the remaining portions of cantilevered strip 172.

It will be seen that cantilevered strip 172 of common contact strip 70 is thus transversely aligned with pin 206 on switch handle 28, as previously discussed.

A substantially rectilinear annular groove 262 is formed in cover 14 and is adapted for receiving upper lip 264 of body 16. Thus, cover 14 fits snugly against body 16 to form insulating enclosure or housing 12. Cover 14 and body 16 can be joined by any means known in the art, such as cementing.

Also seen in FIG. 10 are a plurality of transverse ribs 266 which support flange portions 32 of cover 14.

When electrical switch apparatus 10 is totally assembled, it will be seen that the apparatus provides a plug-in electrical switch for controlling any typical electrical device, adaptable either as a one-way or a three-way switch. Also, the electrical wiring is easily installed without the need for terminal screws. When properly installed, the wall board used in the wall structure will be substantially flush with planar surface 18 of cover 14, and mounting means (not shown) may be provided on cover 14 for receiving fasteners used in mounting a standard switch cover plate (also not shown) of a kind known in the art.

It can be seen, therefore, that the electrical switch apparatus of the present invention is well adapted to carry out the ends and advantages mentioned, as well as those inherent therein. While a presently preferred embodiment of the invention has been illustrated for the purposes of this disclosure, numerous changes in the arrangement and construction of parts may be made by those skilled in the art, which changes are encompassed within the scope and spirit of the present invention as defined by the appended claims.

What is claimed is:

1. An electrical switch apparatus comprising:

an insulating housing defining a switch handle opening therein;

an electrical contact member disposed in said housing and comprising:

wire receiving means for receiving an electrical wire and comprising:

an elongated web portion having a plurality of aligned wire receiving web openings disposed therethrough; and first and second elongated leg portions extending from said web portion, at least one of said leg portions being spot transversely to a length thereof between adjacent ones of said web openings, so that said leg portions can engagingly receive different sizes of wire therebetween in adjacent web openings; and a cantilevered strip extending from said wire receiving means; and a switch handle disposed in said housing and movable between a first and a second position, said switch handle having strip engaging means thereon for engaging said cantilevered strip at least when in one of said first and second positions.

2. The apparatus of claim 1 further comprising supporting means for supporting said cantilevered strip at least when said strip engaging means is engaged with said cantilevered strip.

3. The apparatus of claim 2 wherein said supporting means is characterized by a post extending from said housing and having a free end adjacent said cantilevered strip.

4. The apparatus of claim 1 wherein said housing comprises mounting means for mounting to a wall member.

5. The apparatus of claim 4 wherein said mounting means is characterized by a flange extending from said housing.

6. The apparatus of claim 1 wherein:

said housing defines a wire receiving housing opening therein; and said housing opening is aligned with said wire receiving web opening in said contact strip.

7. The apparatus of claim 1 wherein at least a part of one of said first and second leg portions is arcuate in cross section with a convex side thereof facing the other of said leg portions.

8. The apparatus of claim 7 wherein the other of said first and second leg portions has a planar part adjacent and offset towards said part of said one leg portion, so that said wire is engagingly gripped between said convex side of said arcuate part of said one leg portion and said planar part of said other leg portion with said one leg portion resiliently biased against said wire.

9. The apparatus of claim 1 wherein said housing includes first and second housing sections constructed to be joined together for enclosing said electrical contact strip.

10. The apparatus of claim 1 wherein said wire engaging means further comprises retaining means for engaging said wire when said wire is inserted through said wire receiving web opening and for resisting withdrawal of said wire from said web opening.

11. The apparatus of claim 10 wherein said retaining means of said web portion of said electrical contact strip is a resilient tab punched from said web portion, said tab having a fixed end integrally attached to said web portion and having a free end extending from said web portion away from said housing.

12. The apparatus of claim 11 wherein said free end of said tab has a notch therein for engaging said wire.

13. The apparatus of claim 1 further comprising grounding means for grounding said electrical contact strip when said switch handle is said first position.

14. The apparatus of claim 13 further comprising an electrical grounding strip in said housing and wherein said grounding means comprises a contact on said electrical contact strip engageable with said grounding strip.

15. The apparatus of claim 1 further comprising means for facilitating movement of said switch handle between said first and second positions.

16. The apparatus of claim 15 wherein said means for facilitating movement of said switch handle comprises:
a spring adacent said switch handle; and
spring engaging means on said switch handle for engaging said spring, such that said spring biases said switch handle in one direction as said switch handle is moved over center toward said one direction from a direction opposite said one direction.

17. An electrical switch apparatus comprising:
an insulating housing defining a switch handle opening therein;
an electrical contact member disposed in said housing and comprising:
wire receiving means for receiving an electrical wire and comprising:
a web portion having a wire receiving web opening disposed therethrough;
first and second leg portions extending from said web portion, said leg portions being arranged for engagingly receiving said wire therebetween; and
shoulder means disposed between said leg portions and adjacent said wire receiving web opening for engaging said wire and providing electrical contact therewith; and
a cantilevered strip extending from said wire receiving means; and
a switch handle disposed in said housing and movable between a first and a second position, said switch handle having strip engaging means thereon for engaging said cantilevered strip at least when in one of said first and second positions.

18. The apparatus of claim 17 wherein said shoulder means is characterized by a shoulder stamped from one of said first and second leg portions.

19. The apparatus of claim 18 wherein said shoulder extends substantially perpendicular to said web portion.

20. An electrical switch apparatus comprising:
an insulating enclosure defining a plurality of terminal cavities therein with at least one wire receiving enclosure opening in communication with each of said terminal cavities;
a plurality of electrical conducting members, each member comprising:
a middle web portion having at least one wire receiving web opening therethrough, each web opening being in registry with a corresponding wire receiving enclosure opening, said web portion further including retaining means for engaging a wire when said wire is inserted through said enclosure opening and said web opening for resisting withdrawal of said wire from said web opening;
first and second leg portions extending from said web portion and into a corresponding terminal cavity, said leg portions being arranged for engagingly receiving said wire therebetween;
shoulder means disposed between said leg portions and adjacent said retaining means for engaging said wire and providing electrical contact therewith; and
contact means for providing a point of electrical communication; and
switching means disposed in said enclosure for placing said contact means on at least a pair of said electrical conductor members in electrical communication when in one of first and second positions.

21. The apparatus of claim 20 wherein said contact means on at least a second pair of electrical conducting members are placed in electrical communication when said switching means is in the other of said first and second positions.

22. The apparatus of claim 21 wherein one of said second pair of electrical conductor members is a ground conducting member.

23. The apparatus of claim 20 wherein said plurality of electrical conducting members comprises:
an electrical conducting power member;
an electrical conducting common member; and
an electrical conducting ground member.

24. The apparatus of claim 20 wherein at least part of one of said first and second leg portions is arcuate in cross section with a convex side thereof facing the other of said leg portions.

25. The apparatus of claim 24 wherein the other of said first and second leg portions has a planar part adjacent and offset toward said arcuate part of said one leg portion, so that said wires are engagingly gripped between said convex side of said arcuate part of said one leg portion and said planar part of said other leg portion with said one leg portion resiliently biased against said wire.

26. The apparatus of claim 20 wherein said retaining means of said web portion comprises a resilient tab punched from said web portion, said tab having a fixed end integrally attached to said web portion and having a free end extending from said web portion.

27. The apparatus of claim 26 wherein said free end of said tab has a notch therein for engaging said wire.

28. The apparatus of claim 20 wherein:
each of said electrical conducting members further comprises a cantilevered strip extending from said web portion and having a fixed end integrally formed with said web portion and a free end spaced from said fixed end; and
said contact means of each electrical conducting member is attached to said strip and adjacent said free end thereof.

29. The apparatus of claim 28 wherein said contact means is characterized by at least one electrical contact on each of said cantilevered strips, said contacts being mutually aligned.

30. The apparatus of claim 28 wherein said enclosure comprises wall members separating and locating said cantilevered strips.

31. The apparatus of claim 20 wherein said shoulder means is characterized by a shoulder stamped from one of said first and second leg portions.

32. The apparatus of claim 31 wherein said shoulder extends substantially perpendicular to said middle web portion.

33. An electrical switch comprising:
a body defining a plurality of terminal receiving cavities therein, said body having a wall defining a plurality of wire receiving body openings therethrough in communication with each of said cavities;

a cover positionable adjacent said body and defining a switch handle receiving cavity therein with a switch handle cover opening thereinto and including a plurality of partitions thereon extending toward said body;

a plurality of electrical conducting members disposed in said body, enclosed by said body and said cover, each electrical conducting member comprising:

a terminal portion disposed in a terminal receiving cavity and comprising:

a web portion substantially parallel to said body wall and having at least one wire receiving web opening therein in registry with a corresponding wire receiving body opening;

first and second leg portions extending from said web portion and away from said body wall, said leg portions being arranged for engagingly receiving a wire inserted through a body opening and a corresponding web opening; and a shoulder disposed between said leg portions and adjacent said wire receiving web opening for engaging said wire and providing electrical contact therewith;

an elongated strip having a first end attached to said web portion and a second end spaced from said first end, said strip having a portion extending normally from said web portion and away from said body wall, each of said strips being disposed such that said cover partitions extend between adjacent strips; and at least one electrical contact disposed on each strip adjacent said free end thereof, each of said contacts being aligned with the other of said contacts; and a switch handle comprising:

a lever portion extending outwardly through said switch handle cover opening; and a shaft portion attached to said lever portion and pivotally disposed in said cover switch handle receiving cavity, said shaft portion including strip engaging means for engaging one of said strips and moving said one strip such that a contact thereon is in electrical communication with a contact on a second of said strips as said switch handle is moved from a first to a second position.

34. The switch of claim 33 further comprising over-center biasing means for facilitating movement of said switch handle after said switch handle is moved through a center position as said switch handle is moved between said first and second positions.

35. The switch of claim 33 wherein:

said one strip includes a curvilinear portion extending toward said switch handle shaft; and said strip engaging means is characterized by a pin attached to said switch handle shaft and engageable with said curvilinear portion.

36. The switch of claim 33 wherein said body further comprises a plurality of supporting members for supporting at least said second ends of said strips.

37. The switch of claim 33 wherein said cover further includes a flange portion extending from said body and adapted for attachment to a wall member.

38. The switch of claim 33 wherein said shoulder is stamped from one of said first and second leg portions and extends substantially perpendicular to said web portion.

39. The switch of claim 3 wherein said over-center biasing means comprises:

a lug extending from said switch handle shaft; and a spring disposed in said body and biasingly engaged with said lug.

40. The switch of claim 39 wherein said spring is resiliently biased in a direction substantially perpendicular to an axis of said shaft and has a curvilinear portion with a convex surface facing and engaging said lug.

41. The switch of claim 39 wherein said contact of said one strip is in electrical communication with a contact of a third of said strips when said switch handle is in said first position.

42. The switch of claim 41 wherein:

said one strip forms a portion of a common electrical conducting member;

said second strip forms a portion of a power electrical conducting member; and said third strip forms a portion of a ground electrical conducting member.

43. The switch of claim 42 wherein said contact of said one strip is disposed between said contacts of said second and third strips.

44. An electrical switch apparatus comprising:

an insulating enclosure defining a plurality of terminal cavities therein with at least one wire receiving enclosure opening in communication with each of said terminal cavities;

a plurality of electrical conducting members, each member comprising:

a middle web portion having a plurality of wire receiving web openings therethrough, each web opening being in registry with a corresponding wire receiving enclosure opening, said web portion further including retaining means for engaging a wire when said wire is inserted through one of said enclosure openings and the corresponding web opening for resisting withdrawal of said wire from said corresponding web opening;

first and second leg portions extending from said web portion and into a corresponding terminal cavity, said leg portions being arranged for engagingly receiving said wire therebetween, at least one of said first and second leg portions being split transversely to a length thereof between adjacent web openings so that said leg portions can engagingly receive different sizes of wire in said adjacent web openings; and contact means for providing a point of electrical communication; and switching means disposed in said enclosure for placing said contact means on at least a pair of said electrical conductor members in electrical communication when in one of first and second positions.

* * * * *

UNITED STATES PATENT AND TRADEMARK OFFICE

CERTIFICATE OF CORRECTION

PATENT NO. : 4,761,525

DATED : August 2, 1988

INVENTOR(S) : Phillip W. Stumpff and Richard D. Taylor

It is certified that error appears in the above-identified patent and that said Letters Patent is hereby corrected as shown below:

Column 2, line 2, delete "as" and insert --an-- therefor; line 3, delete "3,738,482" and insert --2,738,482-- therefor.

Column 3, line 26, delete "the", second occurrence, and insert --The-- therefor.

Column 5, lines 20-22, delete "means, preferably characterized by a plurality of terminal receiving".

Column 8, line 22, delete "extend" and insert --extended-- therefor; line 43, delete "cantilevered" and insert --Cantilevered-- therefor; line 62, delete "all" and insert --wall-- therefor.

Claim 1, line 13, delete "spot" and insert --split-- therefor.

Claim 39, line 1, delete "3" and insert --33-- therefor.

Signed and Sealed this

Twenty-second Day of August, 1989

*Attest:*

DONALD J. QUIGG

*Attesting Officer*

*Commissioner of Patents and Trademarks*